United States Patent [19]

Sand et al.

[11] 4,338,156

[45] Jul. 6, 1982

[54] GLAZING STRIP APPLICATOR TOOL

[76] Inventors: Robert H. Sand, 20 Trailsend Dr., Canton, Conn. 06019; Martin Trachtenburg, 14 Candlewood La., Avon, Conn. 06001

[21] Appl. No.: 254,862

[22] Filed: Apr. 16, 1981

[51] Int. Cl.[3] ..... B32B 31/04; E04F 21/00

[52] U.S. Cl. ..... 156/574; 52/749; 156/71; 156/523; 156/579; 156/584

[58] Field of Search ..... 156/574, 584, 579, 523, 156/71, 344; 52/749

[56] References Cited

U.S. PATENT DOCUMENTS

| | | | |
|---|---|---|---|
| 1,496,239 | 6/1924 | Lynch | 156/579 |
| 3,138,512 | 6/1964 | Partin | 156/523 |
| 3,671,364 | 6/1972 | Guinan | 156/574 |
| 3,853,669 | 12/1974 | Werstlein | 156/574 |
| 4,248,659 | 2/1981 | Bopst | 156/574 |

*Primary Examiner*—Michael G. Wityshyn
*Attorney, Agent, or Firm*—McCormick, Paulding & Huber

[57] ABSTRACT

A tool is disclosed for installing a glazing strip in the corner defined by two mutually perpendicular surfaces. The strip comprises extruded polyvinylchloride plastic having a cross sectional shape such that a glazing compound is provided in a central cavity to be extruded through a slot covered temporarily by a paper layer which covers the slit and one entire face of the plastic strip itself so that the strip can be conveniently provided on a roll or the like. The tool provides convenient means for stripping the paper layer from the face of the strip such that it can be first laid in the corner in an initial position by sliding the tool along the plastic strip and simultaneously peeling the paper backing therefrom. The strip is passed through an elongated cavity in the front side of the tool, which cavity exposes a major portion of the strip face so that the paper can be stripped entirely free of the plastic strip if desired. Inturned lips hold the plastic strip in the elongated cavity and a projecting nose portion of the tool provides a radius for the strip to facilitate both the peeling of the paper, and laying of the strip in the corner. The opposite end portion of the tool defines a blunt contoured end portion for pressing the strip after it has been so inserted in a corner to extrude the glazing compound through the slot and into the space between the inner face of the strip and the corner being treated.

7 Claims, 8 Drawing Figures

FIG. 1
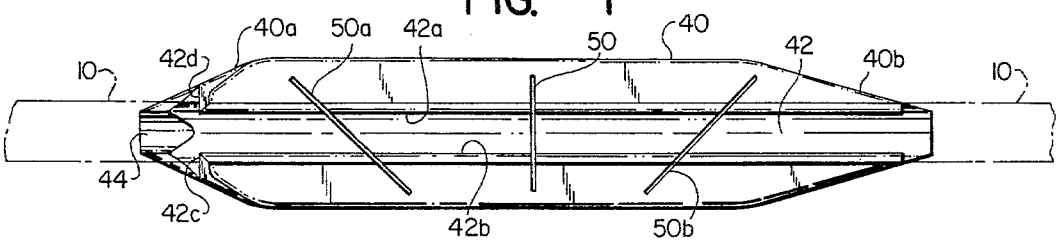
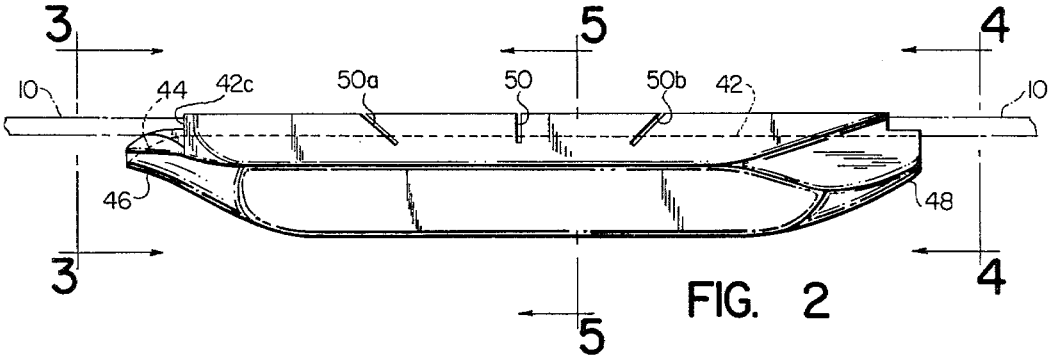
FIG. 2
FIG. 4
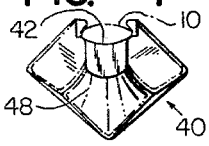
FIG. 3
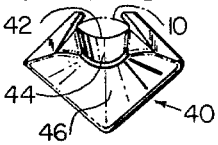
FIG. 5
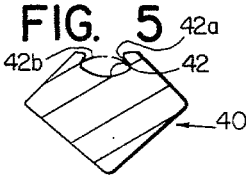
FIG. 6
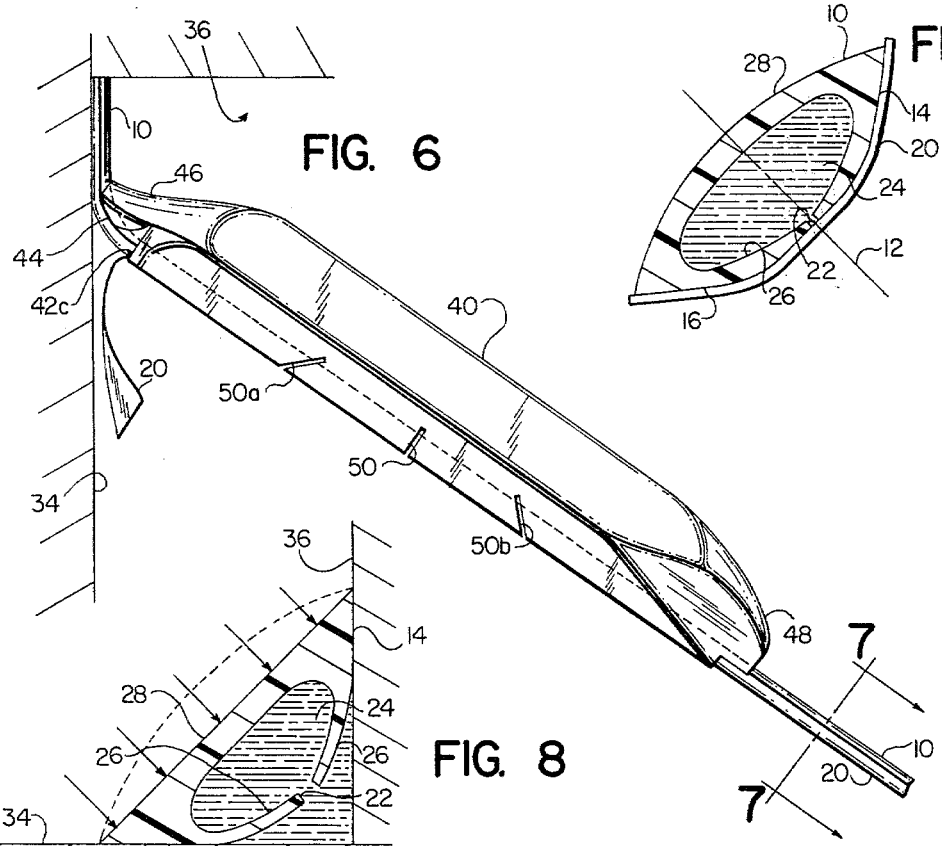
FIG. 7
FIG. 8
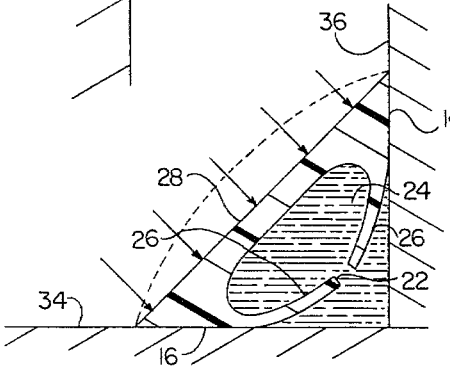

GLAZING STRIP APPLICATOR TOOL

SUMMARY OF THE INVENTION

This invention relates generally to the installation of plastic glazing strip material in window sash or for other purposes, and deals more particularly with an improved tool especially useful in applying strip material of the type described in our prior U.S. Pat. No. 4,138,807 entitled "Glazing Strip and Method" issued Feb. 13, 1979.

By way of background the prior U.S. Pat. No. 4,138,807 is incorporated by reference herein, and it is noted that such a plastic strip is preferably made from a polyvinylchloride material, and has an internal cavity for storing glazing compound or the like. Angularly related lands are provided with a pressure sensitive adhesive material, and these lands are preferably covered by a wax paper or the like, which paper facilitates handling of the strip material until it is actually used. The layer of paper covers a slot or slit in the face of the plastic strip such that glazing compound is held in the cavity until pressure is applied to the opposite face of the strip to extrude the glazing compound through the slot. The present invention provides a convenient tool for applying the strip material to a corner or the like so that the strip can be provided as a fillet in such a corner.

In its presently preferred form the tool comprises an elongated member having an elongated cavity for slidably receiving the plastic strip with the protective layer applied to one face, and with glazing compound stored inside the strip. The elongated cavity in the tool is preferably open to a front side of the elongated tool member itself in order to expose a major portion of the paper layer covering the one face of the strip. Further, the tool member includes opposed lips extending along a major portion of the marginal edges of the cavity's open side. One end of the tool member has a projecting portion which defines a convexly contoured continuation of the inner wall of the cavity in order to guide the strip as the member is moved relative to the strip. More particularly, the tool is generally held at an angle to the corner, and in symmetrical relationship with the two walls defining the corner, with a portion of the strip prepositioned in the corner and the tool being drawn downwardly along the corner to lay the strip therein. The projecting portion of the tool is tapered in width such that it narrows toward the tip in order to facilitate placement of the strip in the corner, and to facilitate movement of the tool member along the corner in this manner.

The primary purpose of the present invention is to provide an improved tool for applying glazing strip of the type described in the above mentioned patent, which tool will permit the extruded plastic strip to be provided in a corner or the like in a manner vastly superior to the unskilled installation of glazing compound directly from a tube for example, or as is the case with glazing of window sash or the like with a conventional putty knife.

BRIEF DESCRIPTION OF THE DRAWINGS

FIG. 1 is a plan view of a glazing strip applicator tool constructed in accordance with the present invention, and shows a plastic strip in phantom lines.

FIG. 2 is a side elevational view of the strip applicator tool illustrated in FIG. 1, with the plastic strip again shown in phantom lines for reference purposes.

FIG. 3 is an end view of the tool illustrated in FIG. 2 taken generally on the line 3—3 of FIG. 2.

FIG. 4 is an end view of the opposite end, being taken generally on the line 4—4 of FIG. 2.

FIG. 5 is a sectional view taken generally on the line 5—5 of FIG. 2.

FIG. 6 is a view of the tool illustrated in FIGS. 1–5 inclusively illustrating the strip applied to a corner defined by mutually perpendicular surfaces, and also illustrating peeling of the paper layer from the front face of the strip.

FIG. 7 is a sectional view through the plastic strip as the strip might be supplied to the user, that is prior to its installation in a corner, this view being taken generally on the line 7—7 of FIG. 6.

FIG. 8 is a view through the same strip illustrated in FIG. 7 but with the paper strip removed and with the strip applied to the corner by the tool as illustrated in FIG. 6 and followed by the application of mechanical pressure to the exposed face of the plastic strip as suggested by the arrows in FIG. 8. The FIG. 6 configuration of the strip in a corner is represented by the broken line in this view.

DETAILED DESCRIPTION

Turning now to the drawing in greater detail, FIG. 7 shows an extruded strip of polyvinylchloride 10 having a shape or cross section suitable for use in carrying out the invention of prior U.S. Pat. No. 4,138,807. As shown, the strip is generally symmetrical about a line 12 which symmetrical shape is adopted primarily for the convenience of the installer. The strip 10 has longitudinally extending lands 14 and 16 symmetrically arranged with respect to the plane of symmetry 12 and oriented at a substantial angle with respect to one another as suggested in FIG. 7. Each of these lands 14 and 16 preferably carries a pressure sensitive adhesive material, which material is covered with a protective paper layer 20. This paper 20 is preferably wax covered so as not to be adversely effected by the adhesive applied to the lands 14 and 16. Further, the paper 20 covers a longitudinally extending slot or opening means best shown at 22 in FIG. 7.

Still with reference to prior U.S. Pat. No. 4,138,807 the strip 10 preferably comprises a carrier for storing a quantity of semi-liquid putty or caulking compound 24 in a central cavity defined for this purpose in the plastic strip 10. The wall portion 26 defining the opening 22 preferably has such a thickness that it is resilient or flexible and adapted to move in order to open the slot 22 as suggested in FIG. 8. The opposite wall 28 of the plastic strip is also of such thickness as to be flexible and resilient in order that mechanical pressure applied to it as suggested by the arrows in FIG. 8 will cause this surface 28 to be flattened from the broken line to the solid line configuration as suggested in this view. This change in strip geometry serves to open the slot 22 as described above. As a result of this action, and as taught in the above mentioned patent, the glazing compound 24 will be extruded through the opening 22 and will fill the cavity defined in the corner provided by the mutually perpendicular surfaces 34 and 36.

By way of reference then it is noted that the carrier strip shown in FIGS. 7 and 8 preferably comprises a strip substantially similar to that disclosed in the above mentioned U.S. Pat. No. 4,138,807, and such a strip in the form shown for it in FIG. 7 can be conveniently stored in rolls or the like so as to be cut to convenient lengths or segments in order to either glaze a window sash, as suggested in said patent, or for other purposes, as for example to provide a fillet in a corner defined between a bathtub and a wall for example.

Turning now to a more detailed description of the tool member illustrated in FIGS. 1 through 6 inclusively, FIG. 1 illustrates a preferred form for such a tool wherein the tool member comprises an elongated member 40 having opposite end portions which are tapered as indicated generally at 40*a* and 40*b*. The front face of the tool 40 may be defined at one corner or vertex of a generally rectangular block of solid material such as wood or plastic for example. It will be apparent from FIG. 5 that the front or uppermost corner of the block defines an elongated cavity 42 so shaped as to slidably receive the plastic strip 10 of FIG. 7. More particularly, the configuration of the cavity 42 in the tool 40 is designed to snugly receive the strip 10 in such a manner that the paper layer 20 is exposed from the front of the tool 40 whereby the peeling of the paper 20 during use of the tool is greatly facilitated, as suggested in FIG. 6.

Still with reference to the cavity 42 not only is this cavity open to the front side of the tool member 40 so as to expose the major portion of the paper layer 20 covering this face of the strip 10, but this elongated cavity is more particularly defined by opposed lips 42*a*, 42*b* which lips also extend along a major portion of the cavities open side and terminate adjacent one end of the tool member at a point just beyond the tapered tip or projecting portion 40*a* of the tool member 40. More particularly, the lips 42*a*, 42*b* can be seen to have end portions 42*c* and 42*d* respectively, which are located adjacent the end of the cavity 42 and which are located at approximately the point at which the projecting portion 40*a* defines a longitudinally extending and arcuately contoured continuation 44 of the inner wall of the cavity 42 as shown to best advantage in FIG. 1 which continuation 44 guides the strip as the member moves relative to the strip in the manner suggested in FIG. 6.

Still with reference to the tapered tip of projecting portion 40*a*, FIG. 2 shows that the tip itself has a rear side 46 opposite the front side defining the cavity continuation 44 which rear side also tapers toward the tip of the projecting portion 40*a* and which surface area 46 of the tool 40 can be used to apply pressure, through the medium of the installer's thumb, in order to move the tool member 40 downwardly in the corner as suggested in FIG. 6. The tool 40 can be conveniently gripped in the hand with the thumb in position to exert downward pressure at the point 46 while the installer may hold the strip 10 in place in the corner with his other hand in order to draw the tool 40 downwardly in the corner to locate the strip 10 in a position such that pressure can later be applied to extrude the compound 24 through the slot 22 as described in our prior art U.S. Pat. No. 4,138,807.

The opposite end 40*b* of the tool 40 includes a convenient portion 48 also tapered slightly inwardly toward the tip as with the portion 46 described above, and more particularly the portion 48 at the opposite end of the tool 40 preferably has a contour as shown best in FIG. 4 such that the pressure necessary to extrude the compound 24 and to flatten the surface 28 of the plastic strip 10 as suggested in FIG. 8 is greatly facilitated.

The front face or vertex of the tool 40 includes slits communicating with the elongated cavity 42 such that the strip 10 can be conveniently cut either at right angles to the longitudinal axis of the strip 10 by means of the slit 50, or the strip 10 can be cut at a 45 degree angle by means of the slots 50*a*, 50*b*.

By way of summary then, and as suggested in FIG. 6, the glazing strip material shown and described in our prior U.S. Pat. No. 4,138,807 or its equivalent can be conveniently laid in a corner or other area to be glazed by use of the tool as suggested in FIG. 6. This is accomplished by inserting the strip longitudinally through the elongated cavity in the tool 40 in order that the user can place a peeled back end portion of the strip in the corner as suggested at 10 in FIG. 6, and can then move his tool downwardly by applying pressure to the area 46 with his thumb and simultaneously strip the paper layer 20 from the strip in order that the adhesive lands 14 and 16 will hold the strip in place in a preliminary position as suggested by the broken lines of FIG. 8. Once the strip has been cut to length and the tool 40 reversed the corner 48 can be applied to the surface 28 of the strip 10 in the corner and pressure applied to extrude the glazing compound 24 from the internal cavity defined in the strip 10 with the result that the compound will fill the space between the opening defining portion 26 of the tape 10 and the corner itself as suggested in FIG. 8.

We claim:

1. A hand held tool for applying a flexible strip of material to a corner defined by two generally perpendicular surfaces to be treated with the strip in order to provide a fillet in the corner, said tool comprising an elongated member defining at least one elongated cavity for receiving a segment of the strip, said cavity being open to a front side of said member to expose a major portion of one face of the strip and said member also including opposed lips extending along a major portion of the marginal edges of the cavity's open side, said elongated member having a projecting portion at one end, said projecting portion defining a longitudinally extending and arcuately contoured continuation of the inner wall of said cavity to guide the strip as the member is moved relative to the strip during use of the tool to provide a fillet in a corner as aforesaid.

2. The tool defined in claim 1 wherein said opposed lips extending along a major portion of the marginal edges of the cavity's open side terminate short of the tip of said projecting portion, and said projecting portion having a tapered width which narrows toward the tip of said projecting portion such that the member can be placed in such a corner for dispensing the strip as the member is so moved.

3. The tool defined in claim 1 wherein said elongated member has an opposite end with a tapered width which narrows toward the tip, said tip of said opposite end having a front side which forms a continuation of said elongated cavity, said tip of said opposite end having a rear side opposite the front side for use in applying pressure to a face of the strip after the strip has been placed as a fillet in a corner or the like to further seat the strip.

4. The tool defined in claim 3 wherein both ends of said elongated member are tapered inwardly toward their respective tips, said projecting portion having its tapered end also tapered from front to rear such that the tip of said projecting portion has a cross sectional shape which is concave to mate at least approximately with a face of the strip being so placed in a corner as aforesaid.

5. The tool defined in claim 1 wherein said front side of said elongated member defines at least one transverse slot communicating with said elongated cavity to facilitate severing said strip with a knife or the like passed through said slot.

6. A tool for applying a glazing strip to a corner or the like, said strip being of the type which includes a hollow thermoplastic carrier filled with glazing compound which compound can be extruded through a longitudinal slot in the carrier after peeling off a protective layer of paper and after the strip itself has been provided as a fillet in such a corner, said tool comprising an elongated member having an elongated cavity for slidably receiving the filled thermoplastic strip with the protective paper still applied to one face of the strip, said cavity being open to a front side of said member to expose a major portion of the paper layer covering the one face of the strip, said member including opposed lips extending along a major portion of the marginal edges of the cavity's open side, said elongated member having a projecting portion at one end, said projecting portion defining a longitudinally extending and arcuately contoured continuation of the inner wall of said cavity to guide the strip as the member is moved relative to the strip, and said projecting portion having a tapered width which narrows toward the tip of said projecting portion to facilitate placement of the strip in a corner and movement of the member along the corner.

7. The tool defined in claim 6 wherein said member has an end opposite said one end which also narrows toward its tip, said opposite end tip having a front side which forms a continuation of said inner cavity and a rear side of said opposite end tip having a blunt contour to apply pressure to the exposed face of the strip after placement in a corner to cause glazing compound to be extruded through the slot.

* * * * *